US007147550B2

(12) United States Patent
Chen

(10) Patent No.: US 7,147,550 B2
(45) Date of Patent: Dec. 12, 2006

(54) HOLDING APPARATUS FOR GRINDING MEMBERS

(75) Inventor: Lung-Pao Chen, Hsinchu County (TW)

(73) Assignee: Sunmatch Industrial Co., Ltd., Hsinchu County (TW)

( * ) Notice: Subject to any disclaimer, the term of this patent is extended or adjusted under 35 U.S.C. 154(b) by 0 days.

(21) Appl. No.: 11/125,146

(22) Filed: May 10, 2005

(65) Prior Publication Data

US 2006/0258275 A1 Nov. 16, 2006

(51) Int. Cl.
*B24D 15/00* (2006.01)

(52) U.S. Cl. ..... 451/520; 451/365; 451/515; 301/37.31

(58) Field of Classification Search ..... 451/520, 451/514, 515, 516, 344, 350, 358, 359, 365; 301/35.61, 37.102, 37.31, 37.34
See application file for complete search history.

(56) References Cited

U.S. PATENT DOCUMENTS 3,574,978 A * 4/1971 Block ..... 451/509
5,094,563 A * 3/1992 Carletti ..... 403/194
5,390,448 A * 2/1995 Schimweg ..... 451/478
6,302,617 B1 * 10/2001 Rumpp ..... 403/348
7,007,900 B1 * 3/2006 Goodwin et al. ..... 248/68.1
2004/0028486 A1 * 2/2004 Englund ..... 407/90
2005/0223400 A1 * 10/2005 Matsushita et al. ..... 720/702
2006/0037871 A1 * 2/2006 Jin et al. ..... 206/5.1

* cited by examiner

*Primary Examiner*—Eileen P. Morgan
(74) *Attorney, Agent, or Firm*—Birch, Stewart, Kolasch & Birch, LLP

(57) ABSTRACT

A holding apparatus for grinding members includes two clamping disks that have respectively a plurality of anchor plates and a plurality of anchor slots on different perimeters. The anchor plates and anchor slots may be wedged to form a mechanical interference between the two clamping disks to hold a grinding member securely. The apparatus thus constructed can enhance the structural strength of the grinding member and prevent the grinding member from deforming at high speed rotation.

14 Claims, 5 Drawing Sheets

HOLDING APPARATUS FOR GRINDING MEMBERS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein;

FIELD OF THE INVENTION

The present invention relates to a holding apparatus for grinding members and particularly to a holding apparatus adopted for use on pneumatic tools.

BACKGROUND OF THE INVENTION

The commonly seen pneumatic tool aims to provide a driving force through a pneumatic motor to rotate a spindle and drive a grinding member coupled on a distal end of the spindle to perform surface grinding operation. Refer to FIG. 1 for a conventional grinding member 10 which is coupled with a fastening element 11 in an integrated manner. The fastening element 11 has a screw thread 12 on a distal end to be fastened to a coupling head 22 of a pneumatic tool 20.

As the grinding member 10 and the fastening element 11 are fabricated in an integrated manner, when the grinding member 10 has been used for a period of time and has to be replaced, the fastening element 11 also is discarded. This results in an extra cost.

Moreover, the grinding member 10 is fastened to the coupling head 22 of the pneumatic tool 20 merely by the fastening element 11. The grinding member 10 is prone to deform when being rotated at high speed.

SUMMARY OF THE INVENTION

Therefore the primary object of the present invention is to provide a holding apparatus for grinding members that is easy to produce and also can enhance the structural strength of the grinding members.

In order to achieve the foregoing object, the holding apparatus according to the invention aims to couple a grinding member (such as a grinding wheel, a steel brush or the like). It includes mainly a first clamping disk and a second clamping disk. The first clamping disk has a plurality of first anchor plates and a plurality of first anchor slots on one side. The first anchor plates and the first anchor slots are located on different perimeters in an alternate manner. The second clamping disk has a plurality of second anchor plates and a plurality of second anchor slots on one side. The second anchor plates and the second anchor slots are located on different perimeters in an alternate manner. The first anchor plates correspond to the second anchor slots. The second anchor plates correspond to the first anchor slots. The first anchor plates and the second anchor plates can be wedged respectively in the second anchor slots and the first anchor slots so that the first clamping disk and the second clamping disk form a mechanical interference with each other to achieve an anchoring effect.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
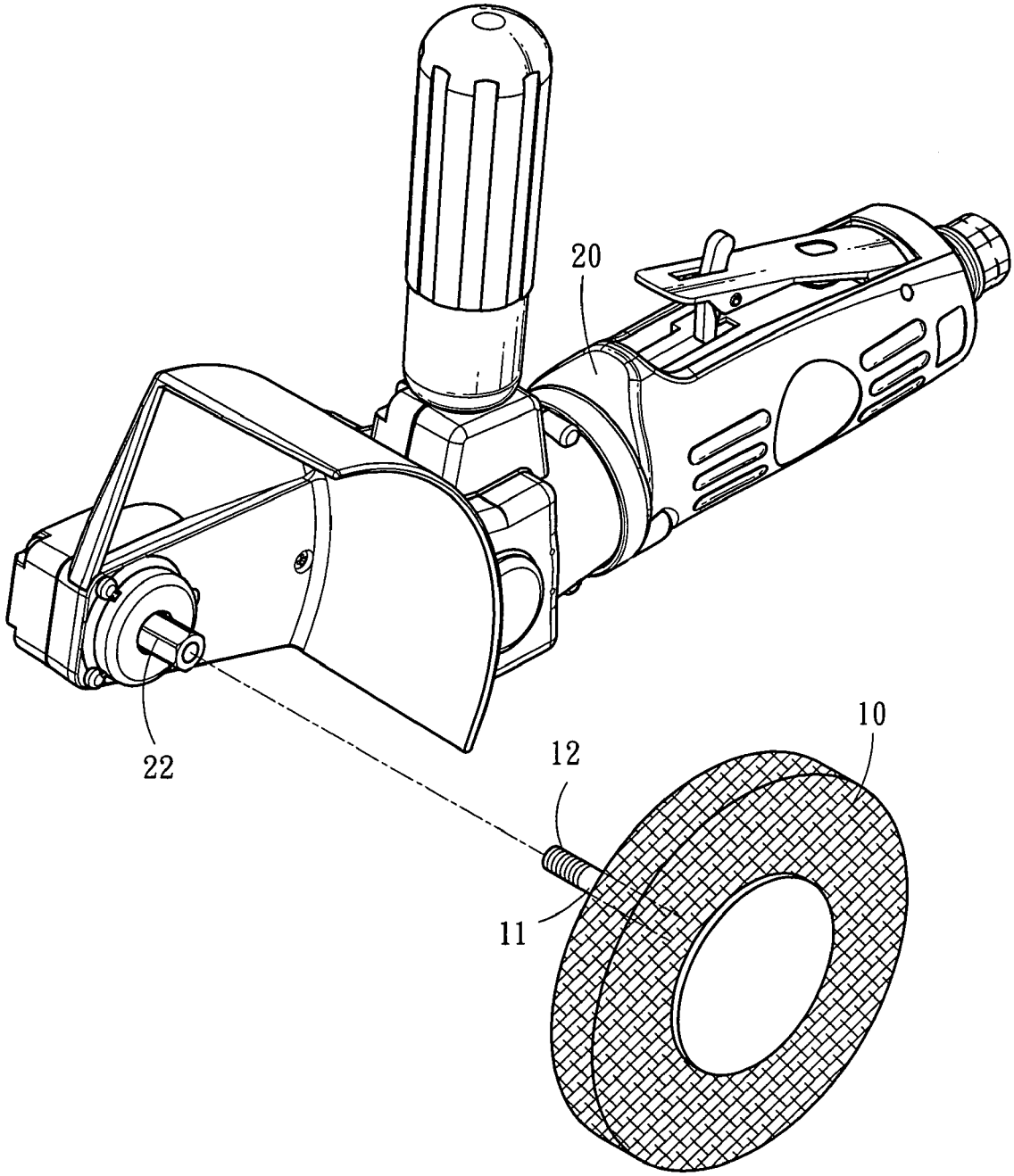
Fig.1 PRIOR ART
FIG. 1 is an exploded view of a conventional grinding member fastened to a pneumatic tool.
Figure 2:
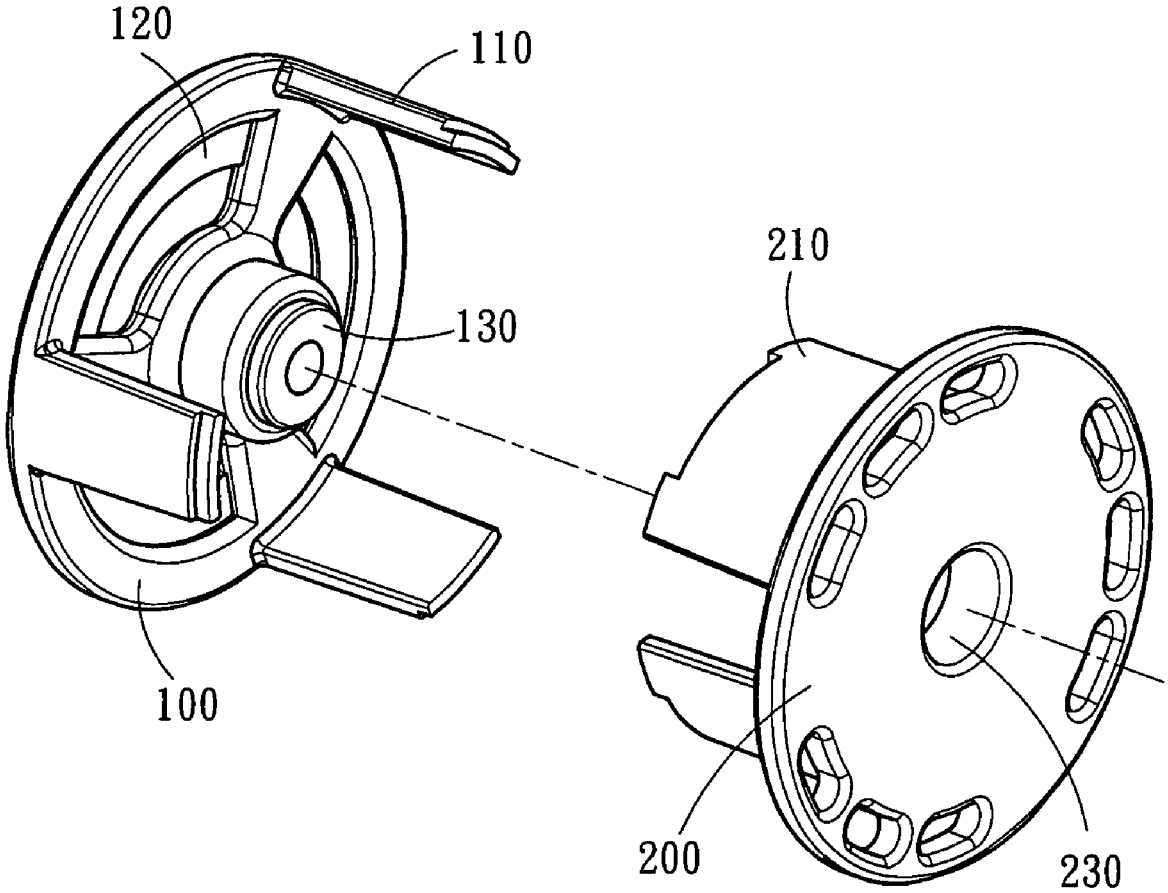
FIG. 2 is an exploded view of the holding apparatus of the present invention.
Figure 3:
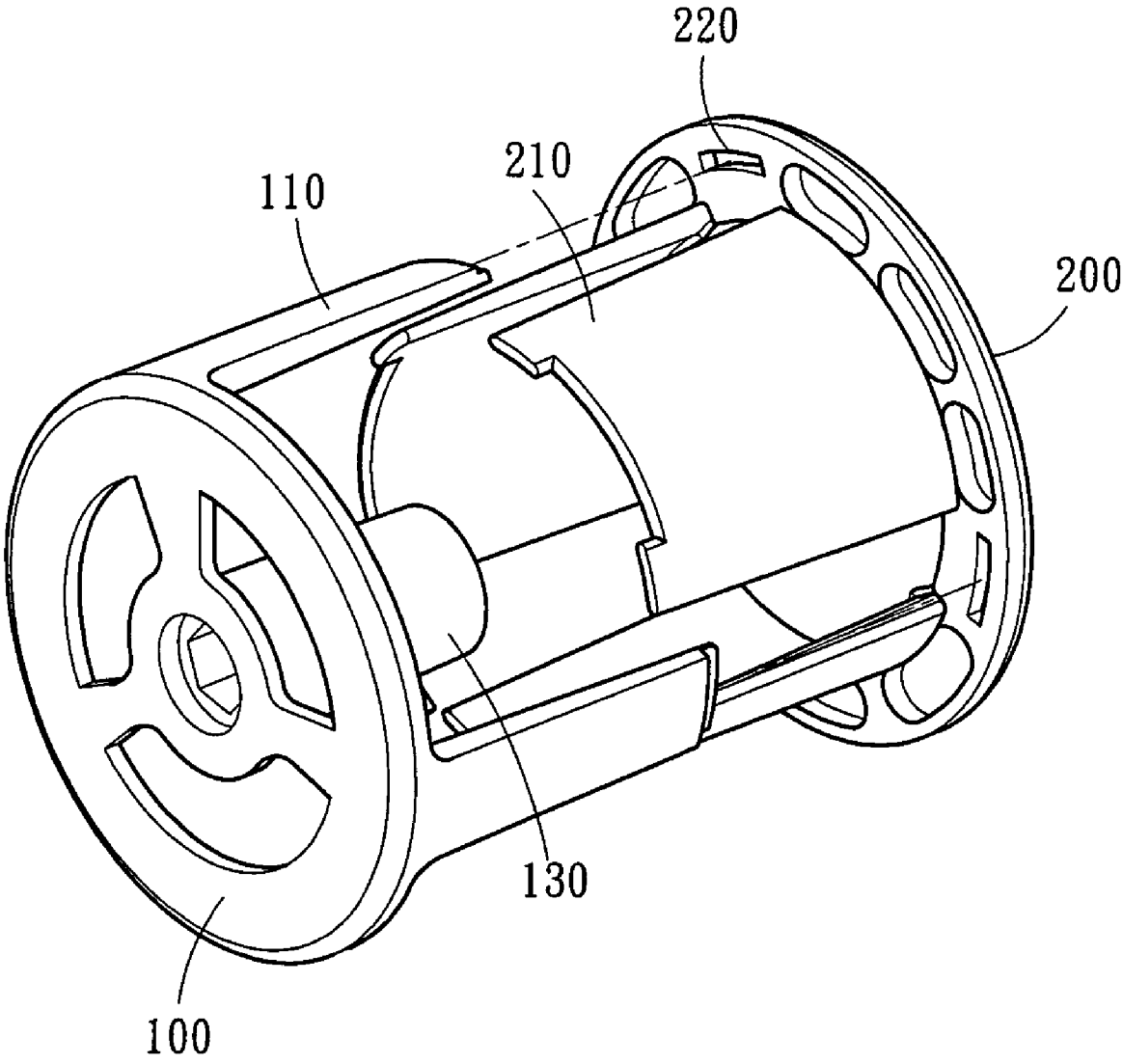
FIG. 3 is another exploded view of the holding apparatus of the present invention.
Figure 4:
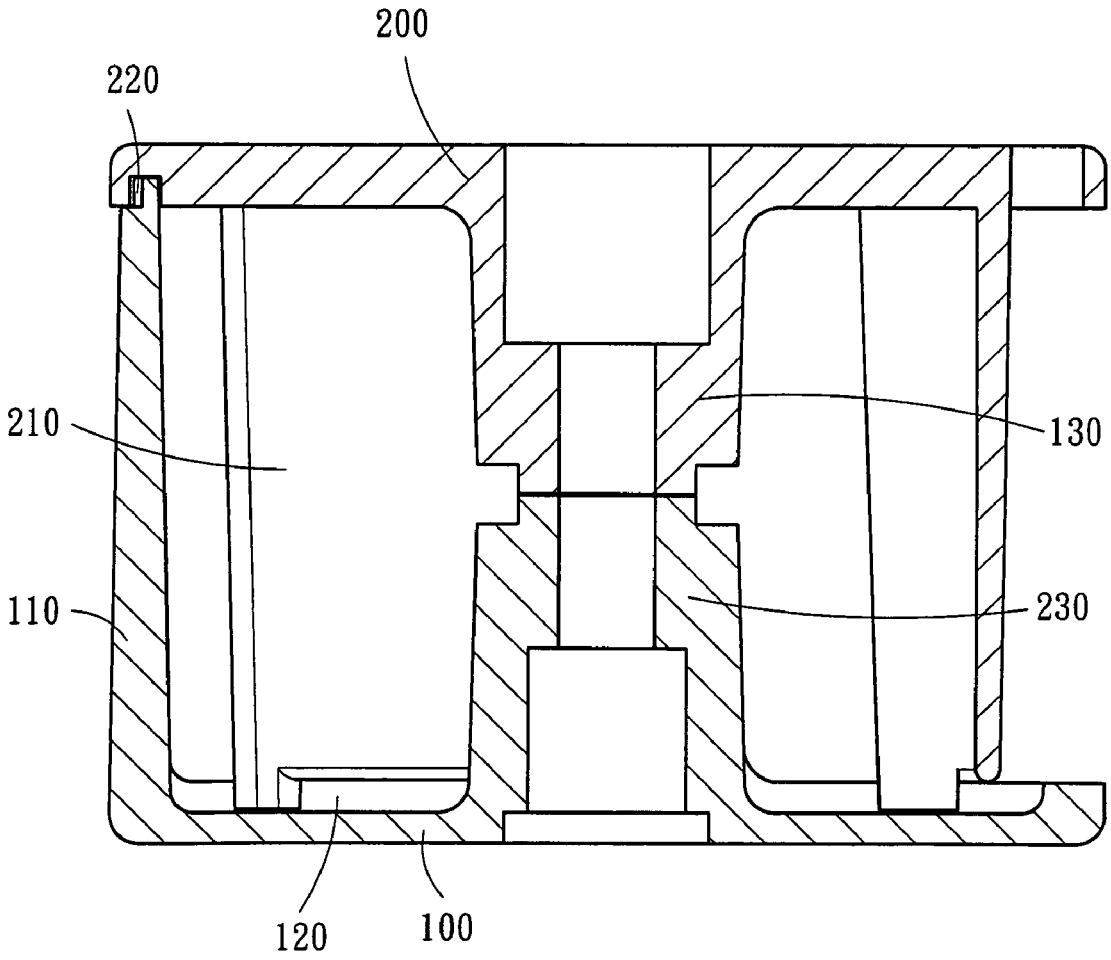
FIG. 4 is a sectional view of the holding apparatus of the present invention in a coupled condition.

Please refer to FIGS. 2, 3 and 4 for an embodiment of the holding apparatus for grinding members of the invention. It mainly includes a first clamping disk 100 and a second clamping disk 200. The first clamping disk 100 has a plurality of first anchor plates 110 and a plurality of first anchor slots 120 on one side. The first anchor plates 110 and the first anchor slots 120 are located on different perimeters in an alternate manner. In this embodiment, the first anchor plates 110 are located on a perimeter greater than the perimeter where the first anchor slots 120 are formed (referring to FIG. 2).

The second clamping disk 200 has a plurality of second anchor plates 210 and a plurality of second anchor slots 220 on one side. The second anchor plates 210 and the second anchor slots 220 are located on different perimeters in an alternate manner. In this embodiment, the second anchor plates 210 are located on a perimeter greater than the perimeter where the second anchor slots 220 are formed (referring to FIG. 3).

The first anchor plates 110 correspond to the second anchor slots 220. The second anchor plates 210 correspond to the first anchor slots 120. The first anchor plates 110 and the second anchor plates 210 can be wedged respectively in the second anchor slots 220 and the first anchor slots 120 so that the first clamping disk 100 and the second clamping disk 200 form a mechanical interference with each other to achieve an anchoring effect.

The first anchor slots 120 and the second anchor slots 220 may run through or not run through the first clamping disk 110 and the second clamping disk 200. There is no limitation to their shape and number provided that the anchor slots and the anchor plates can be coupled together. The first clamping disk 100 and the second clamping disk 200 may be made of aluminum or an aluminum alloy that has a greater structural strength.

Figure 5:
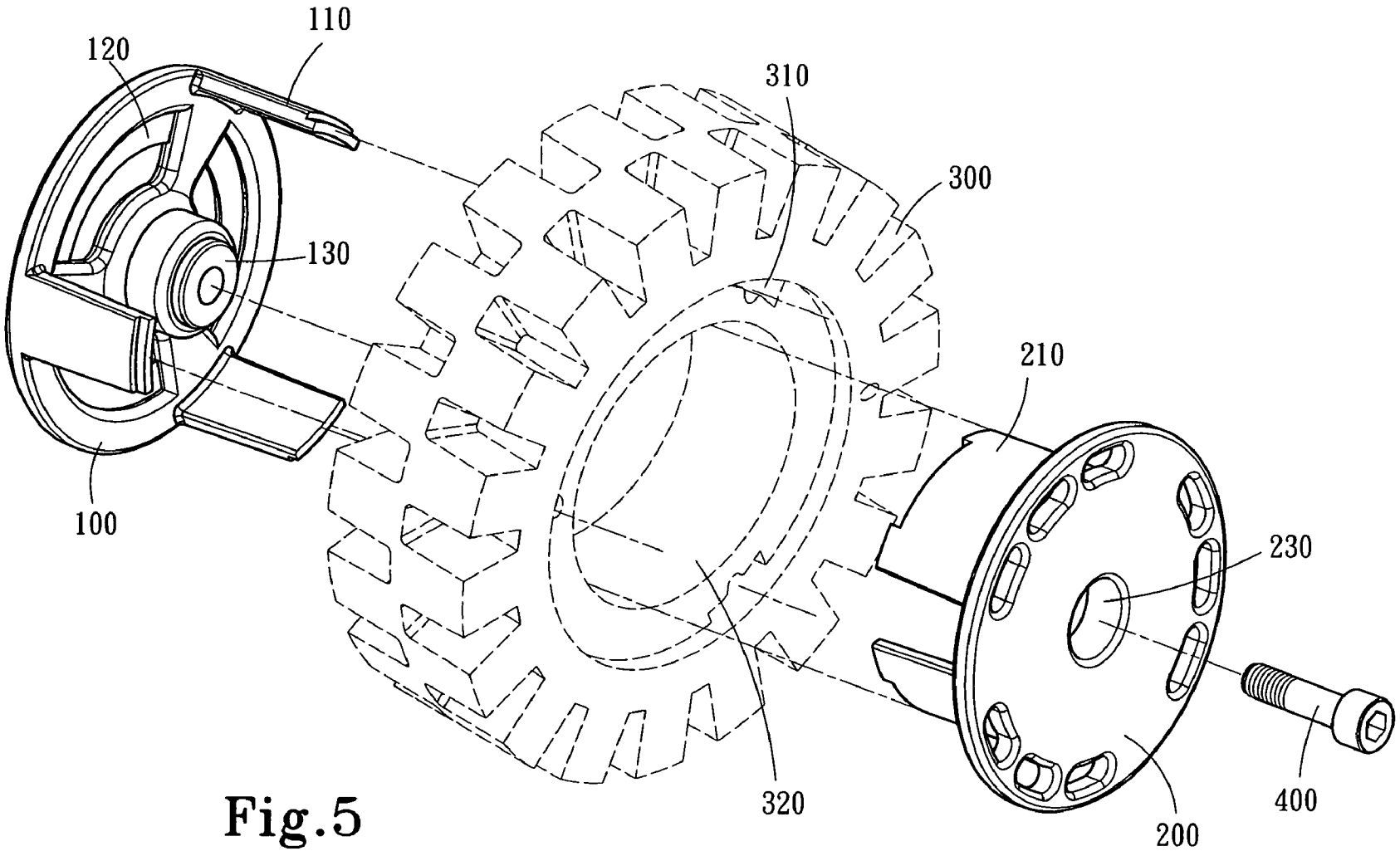
FIG. 5 is a schematic view of the holding apparatus of the invention for holding a grinding member.

Refer to FIG. 5 for the holding apparatus of the invention to hold a grinding member 300. The grinding member 300 is a grinding wheel which serves as an example (of course a steel brush or the like for surface treatment may also be used). For assembly, insert the first anchor plates 110 of the first clamping disk 100 into troughs 310 formed on the grinding member 300; next, insert the second anchor plates 210 of the second clamping disk 200 into a round opening 320 formed in the center of the grinding member 300; wedge the first anchor plates 110 and the second anchor plates 210 respectively in the corresponding second anchor slots 220 and the first anchor slots 120 so that the first clamping disk 100 and the second clamping disk 200 form a mechanical interference and clamp the grinding member 300. Thus the grinding member 300 has a greater structural strength and can be rotated at high speed without deforming. As a result, grinding operation may be performed more smoothly.

Referring to the drawings previously discussed, the centers of the first clamping disk 100 and the second clamping disk 200 may further have respectively a first hollow duct 130 and a second hollow duct 230 that are in contact with each other after assembly. This can further increase the structural strength of the grinding member 300. Based on this design, a fastening element 400 may be provided (as shown in FIG. 5) to run through the first hollow duct 130 and the second hollow duct 230 to fasten the grinding member 300 to a pneumatic tool (not shown in the drawings). As a result, the fastening element 400 may be used repeatedly. Compared with the conventional techniques that have the fastening element integrated with the grinding member, and has to be discarded when the grinding member is replaced, the invention can save the cost.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A holding apparatus for grinding members to hold a grinding member, comprising:

a first clamping disk which has a plurality of first anchor plates and a plurality of first anchor slots on one side thereof, the first clamping disk having a center with the plurality of first anchor plates being located at a different distance from the center of the first clamping disk than the plurality of first anchor slots; and a second clamping disk which has a plurality of second anchor plates and a plurality of second anchor slots on one side thereof, the second clamping disk having a center with the plurality of second anchor plates being located at a different distance from the center of the second clamping disk than the plurality of second anchor slots;

the first anchor plates mating with the second anchor slots and the second anchor plates mating with the first anchor slots to allow the first clamping disk and the second clamping disk to form a mechanical interference to couple with each other and to releasably hold the grinding member between the first clamping disk and the second clamping disk.

2. The holding apparatus of claim 1, wherein the first clamping disk and the second clamping disk have respectively a first hollow duct and a second hollow duct extended respectively from the center thereof and in contact with each other.

3. The coupling structure of claim 1, wherein the first clamping disk and the second clamping disk are made of aluminum.

4. The coupling structure of claim 1, wherein the first clamping disk and the second clamping disk are made of an aluminum alloy.

5. The coupling structure of claim 1, wherein the first anchor plates are perpendicular to the side of the first clamping disk and the second anchor plates are perpendicular to the side of the second clamping disk.

6. The coupling structure of claim 2, wherein the first hollow duct extends away from the side of the first clamping disk and the second hollow duct extends away from the side of the second clamping disk.

7. The coupling structure of claim 6, wherein a length of the first hollow duct is the same as a length of the second hollow duct.

8. The coupling structure of claim 1, wherein the first anchor slots are bigger than the second anchor slots and wherein the second anchor plates are bigger than the first anchor plates.

9. The coupling structure of claim 1, wherein the first anchor plates are a different size than the second anchor plates.

10. The coupling structure of claim 1, wherein an outer perimeter of the first clamping disk is unbroken and an outer perimeter of the second clamping disk is unbroken, the first anchor plates and the first anchor slots being within the outer perimeter of the first clamping disk and the second anchor plates and the second anchor slots being within the outer perimeter of the second clamping disk.

11. The coupling structure of claim 10, wherein the first anchor plates are perpendicular to the side of the first clamping disk and the second anchor plates are perpendicular to the side of the second clamping disk.

12. The coupling structure of claim 11, wherein the first clamping disk has a first hollow duct at the center thereof and the second clamping disk has a second hollow duct at a center thereof, the first and second hollow ducts touch one another when the grinding member is between the first and second clamping disk.

13. The coupling structure of claim 12, wherein the first hollow duct extends away from the side of the first clamping disk and the second hollow duct extends away from the side of the second clamping disk.

14. The coupling structure of claim 13, wherein a length of the first hollow duct is the same as a length of the second hollow duct.

* * * * *